US006076670A

United States Patent [19]

Yeranossian

[11] Patent Number: 6,076,670

[45] Date of Patent: Jun. 20, 2000

[54] TOOTH BRUSH TRAY WITH CANOPY

[75] Inventor: Karl Yeranossian, Pearl River, N.Y.

[73] Assignee: P.O.P. Displays, Inc., Woodside, N.Y.

[21] Appl. No.: 09/122,550

[22] Filed: Jul. 24, 1998

Related U.S. Application Data

[63] Continuation-in-part of application No. 08/890,016, Jul. 10, 1997, abandoned.

[60] Provisional application No. 60/015,703, Jul. 10, 1996.

[51] Int. Cl.[7] ..... B65G 59/00

[52] U.S. Cl. ..... 206/362; 221/114; 221/124; 221/279

[58] Field of Search ..... 206/362, 425, 206/556, 565, 736, 756; 221/114, 124, 131, 279; 211/51; 220/532

[56] References Cited

U.S. PATENT DOCUMENTS

| | | | |
|---|---|---|---|
| 1,284,597 | 11/1918 | Clinchy | 221/279 |
| 2,222,887 | 11/1940 | Willey | 221/279 |
| 3,357,597 | 12/1967 | Groff | 221/279 |
| 4,728,158 | 3/1988 | D'Elia et al. | 220/532 |
| 4,741,438 | 5/1988 | Mastronardo et al. | 220/532 |
| 4,807,760 | 2/1989 | Sussman | 206/561 |
| 5,131,563 | 7/1992 | Yablans | 221/124 |
| 5,311,993 | 5/1994 | Yablans et al. | 221/124 |
| 5,445,269 | 8/1995 | Williams | 206/425 |

*Primary Examiner*—David T. Fidei
*Attorney, Agent, or Firm*—Nolte, Nolte & Hunter

[57] ABSTRACT

A product display dispenser in which products are loaded in a tray and brought forward by a spring pusher to the dispensing position one-by-one as the forwardmost product is lifted from the dispenser. A canopy overlies the products and prevents the upward movement of the product. A retaining lip is disposed on the underside of the canopy to prevent any rearward movement of the product when the first product is removed from the dispenser.

6 Claims, 4 Drawing Sheets

TOOTH BRUSH TRAY WITH CANOPY

This is a continuation-in part of Ser. No. 08/890,016, now abandoned, filed Jul. 10, 1997 which derives its filing date from provisional application Ser. No. 60/015,703, filed Jul. 10, 1996 entitled TOOTH BRUSH TRAY WITH CANOPY.

BACKGROUND OF THE INVENTION

1. FIELD OF THE INVENTION

The present invention relates to a product display dispenser in which packaged products are loaded in a tray and brought forward by a spring pusher to the dispensing position one-by-one as the forwardmost product is lifted from the dispenser. In particular, a specially designed canopy with a retaining lip prevents additional product from being lifted when the forwardmost product is removed.

2. THE PRIOR ART

Display dispensers for packaged articles such as tooth brushes and lipsticks are typically comprised of a tray with front, rear, bottom and side walls and divider walls dividing the tray into side-by-side, front-to-back compartments in which product pushers are provided for pushing the articles toward the front of the compartment.

One problem which arises with such dispensers is that when the first-in-line article in any given compartment is lifted by a consumer, the friction between the first-in-line article and the next-in-line article frequently causes the next-in-line article to pop up with the first-in-line article and, due to the force of the pusher, tends to jump forward. Various circumstances, such as holding the first-in-line article rigid, may cause the next-in-line article to fall back. In all events, the display may soon become quite disordered.

SUMMARY OF THE INVENTION

It is an object of the present invention to provide a product display dispenser with a canopy wherein the canopy prevents the next-in-line article from falling out of the product display when the forwardmost article is removed.

It is a further object of the invention to provide a clear, well organized device which dispenses a variety of items including, but not limited to, tooth brushes.

It is a final object of the invention to provide a simple and inexpensive device to manufacture which is reliable.

The invention resides in the provision of a canopy including a specially designed retaining lip, placed on the underside of the canopy. Occasionally, when the forwardmost packaged product is lifted from the front of the dispenser, the next-in-line packaged product is also lifted due to the friction between the two products. Using the specially designed canopy of the invention, the next-in-line product will not be lifted from its position in the tray because of the retaining lip of the overlying canopy.

BRIEF DESCRIPTION OF THE DRAWINGS

Other objects and features of the present invention will become apparent from the following detailed descriptions considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
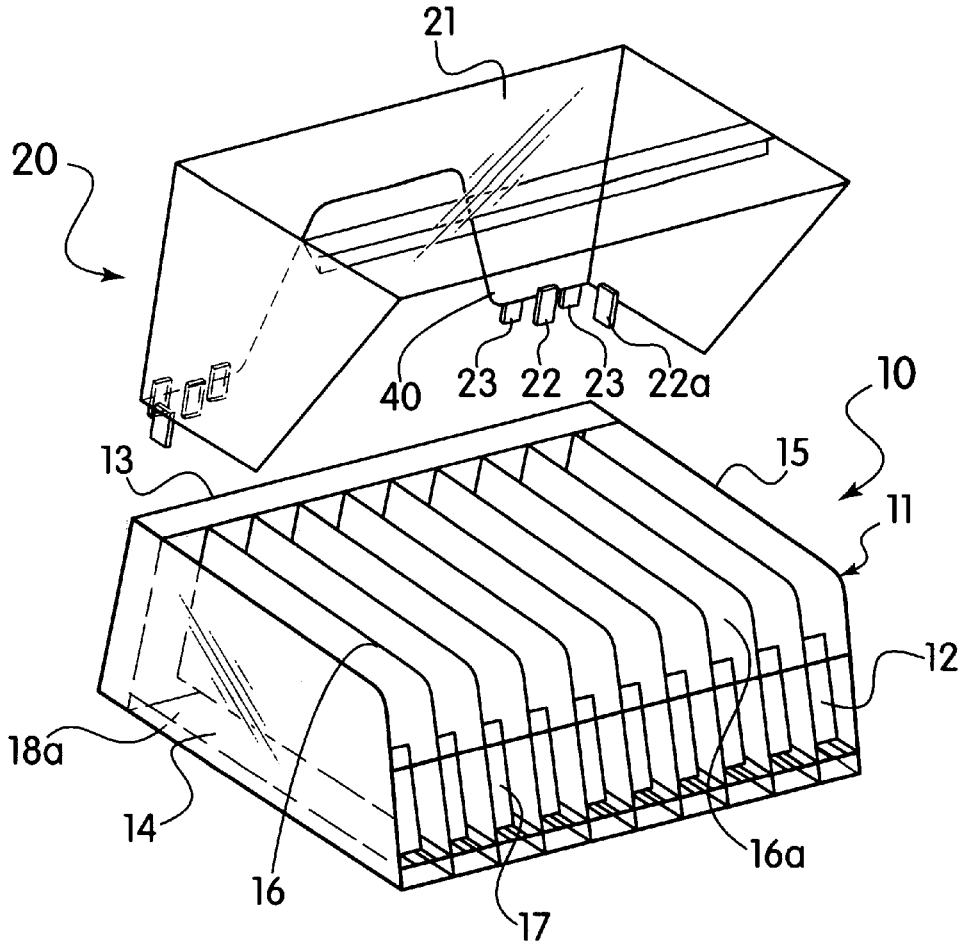
FIG. 1 is a perspective view of a product display dispenser with a canopy, according to the invention.

Turning now in detail to the drawings, FIG. 1 shows the invention, a product display dispenser 10 comprising a tray 11 having a front wall 12, a back wall 13, a pair of side walls 14, 15, a bottom wall 18*a*, and a canopy 20. Canopy 20 comprises a rear wall 40 and a topmost wall 21 and is constructed and arranged so that topmost wall 21 extends over all of the product. In some cases, depending upon the type of cartons displayed, the canopy will extend over all of the product except the front row. A plurality of dividers 16 divide tray 11 into a plurality of back-to-front, side-by-side compartments 16*a*, in each of which there is disposed a spring loaded pusher 17, shown in the forward position in the figures.

Figure 2:
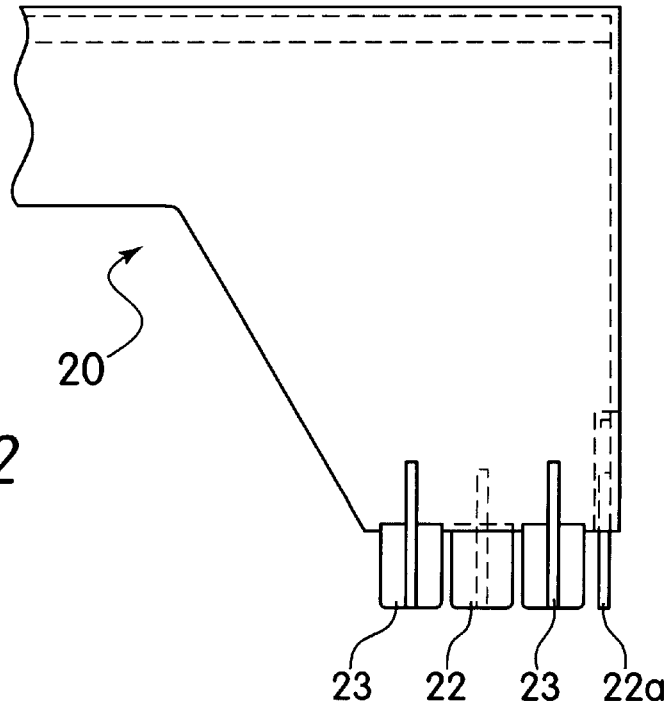
FIG. 2 is a partial rear plan view of the canopy of FIG. 1 showing a plurality of connection tabs used to secure the canopy to the tray.

Referring to FIG. 2, there is shown a rear plan view of half of canopy 20. Canopy 20 is disposed on tray 11 of FIG. 1, via integral clip fingers, disposed on said rear wall 40, comprised in this instance of two internal support tabs 22, two side support tabs 22*a* and four external support tabs 23.

Figure 3:
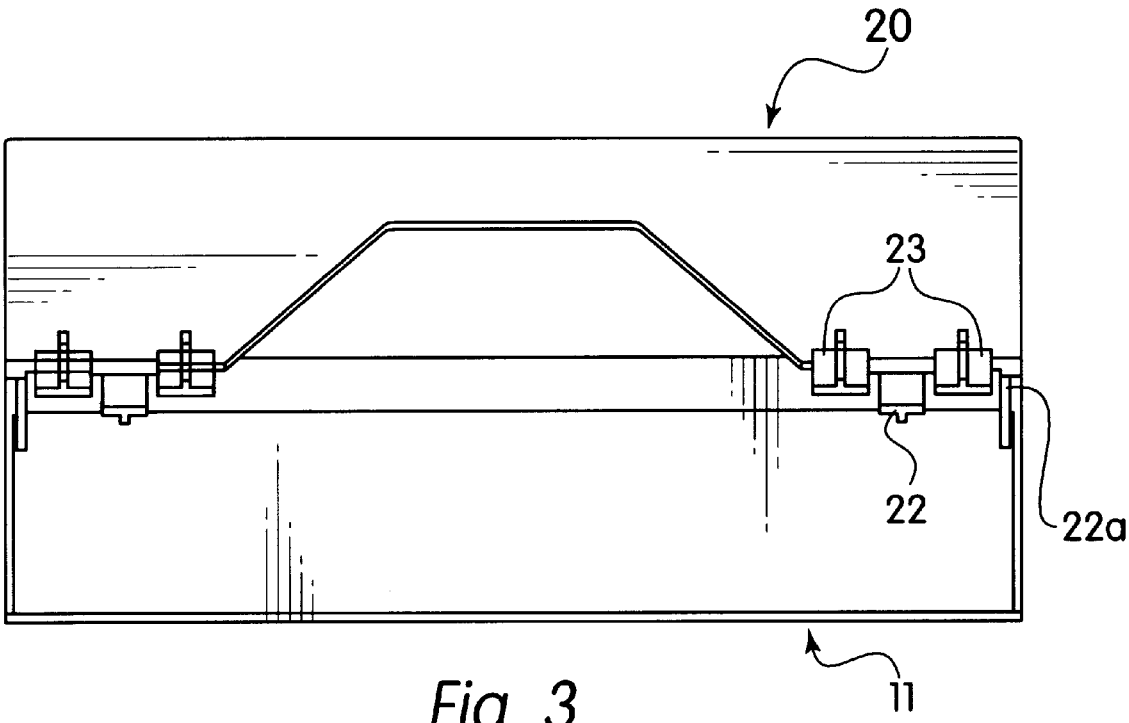
FIG. 3 is a rear plan view of the canopy of FIG. 1 showing the plurality of connection tabs used to secure the canopy to the tray.

Referring to FIG. 3, there is shown a rear plan view of canopy 20. Side support tabs 22*a*, align canopy 20 with tray 11, and prevent any side-to-side and front-to-back movement.

Figure 4:
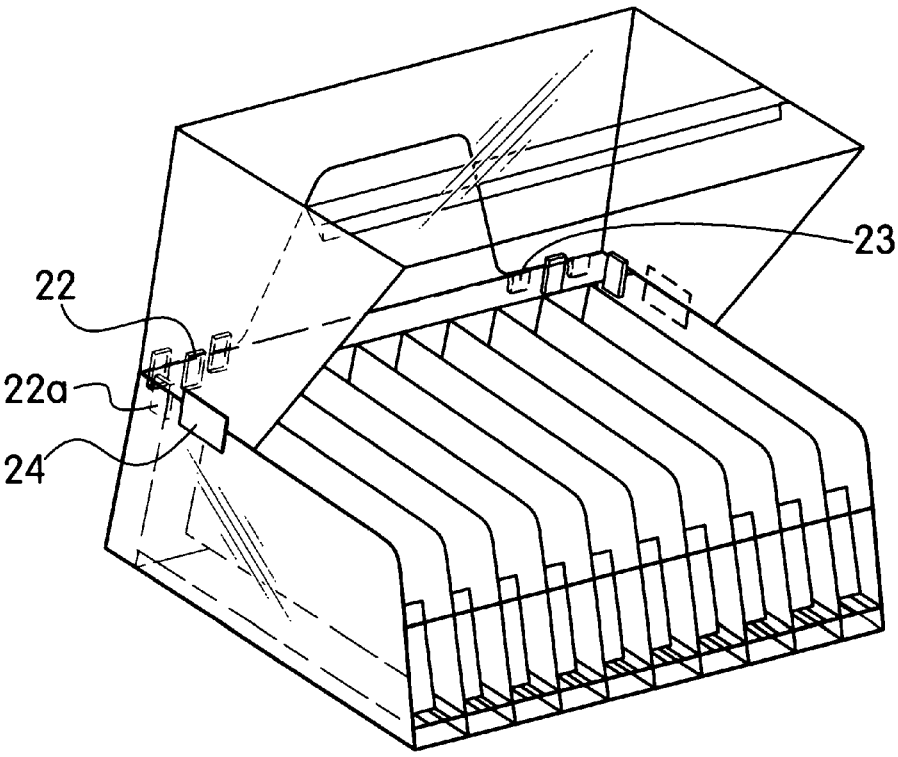
FIG. 4 is a perspective view of the product display dispenser with canopy of FIG. 1, wherein the canopy is attached to the tray.

Referring to FIG. 4, there is shown a perspective view of product display dispenser 10 with canopy 20 of FIG. 1 attached to tray 11 using side support tabs 22*a*, interior support tabs 22 and exterior support tabs 23 in conjunction with a piece of self-bonding tape 24 to stabilize the canopy and tray.

Figure 5:
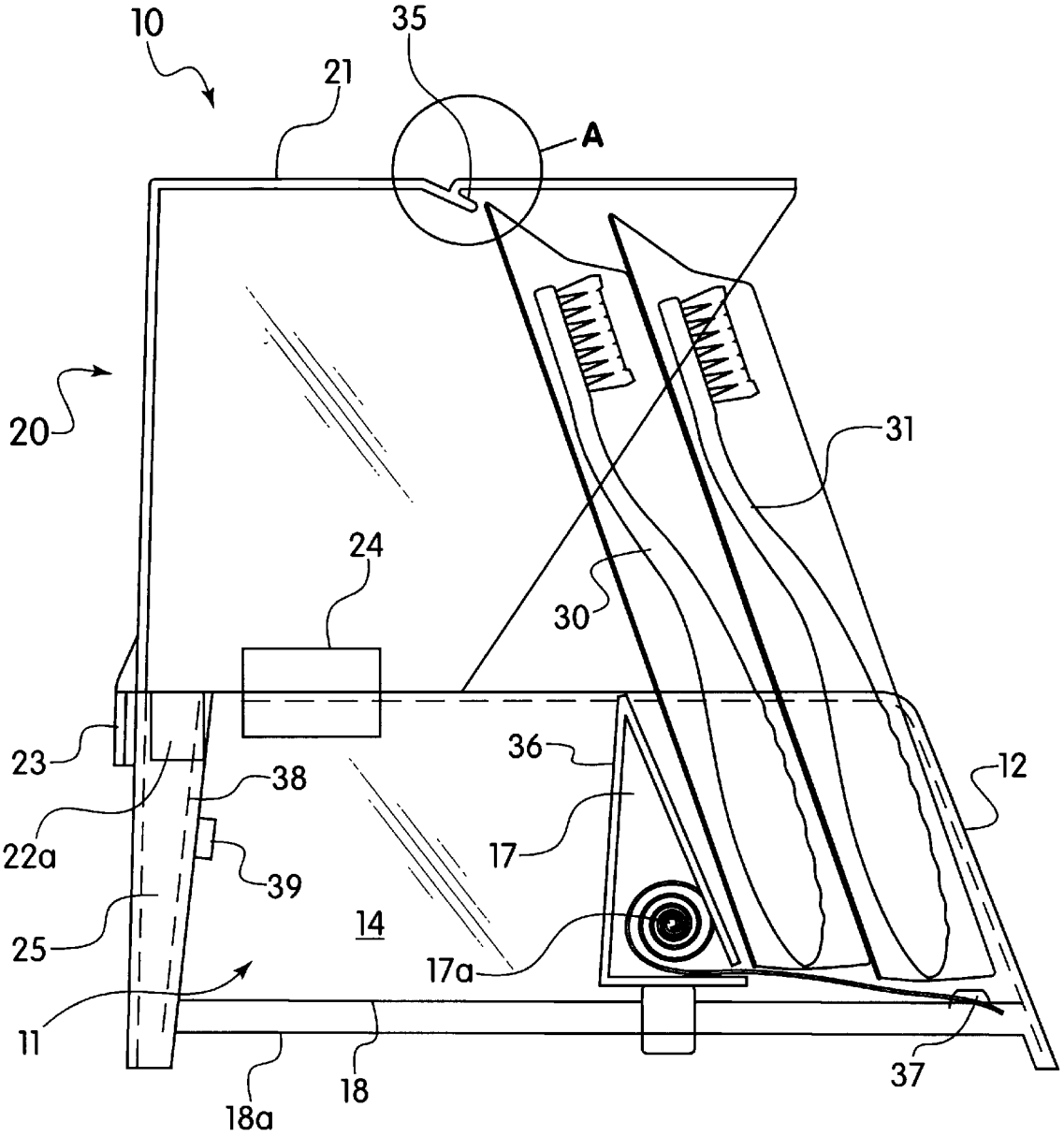
FIG. 5 is a side plan view of the invention showing the rear storage compartment and the extension of the canopy over the products.

Referring to FIG. 5, there is shown a side plan view of product display dispenser 10. If a next-in-line product 30 is lifted, due to the friction between it and a forwardmost product 31, next-in-line product 30 will be stopped from upward movement and kept within the tray in its position by a retaining lip 35 disposed on the underside of topmost wall 21 and will be brought forward in proper place by the pressure of pusher 17 after the fowardmost product 31 is lifted from the compartment. Retaining lip 35 is downwardly angled and extends toward front wall 12.

It is to be noted that not only the next-in-line product 30, but those behind may also be affected by friction because of a domino effect, but they likewise are restrained by topmost wall 21 and retaining lip 35.

Product display dispenser 10 contains pushers 17 of known types which ride along a longitudinal slot 18 in bottom wall 18*a* in a known manner. A coil spring 17*a*, having a free end 37, is supported at a back wall 36 of pusher 17 and free end 37 of spring 17*a* is secured at the forwardmost part of tray 11 so that when pusher 17 is drawn to the rear of its respective compartment, or is pushed that way by the disposition in the compartment of a plurality of articles, comprising, for example, packaged products, pusher 17 will then be operative to push the products forward as the forwardmost product 31 is lifted upwardly from tray 11 by a customer.

Another feature of product display dispenser 10 is the provision of a compartment 25 formed between rear wall 13 and storage divider wall 38. Compartment 25 is used to store removable dividers 16. Removable dividers 16 allow adjacent compartments to be used for two-for-one sales where two of the products are packaged in one wrapper or container. Dividers 16 may be supported in place in a well known manner by divider tab and floor grooves (not shown) or by grooves 39 in storage divider wall 38 and bottom wall 18*a* or front wall 12 of tray 11.

Figure 6:
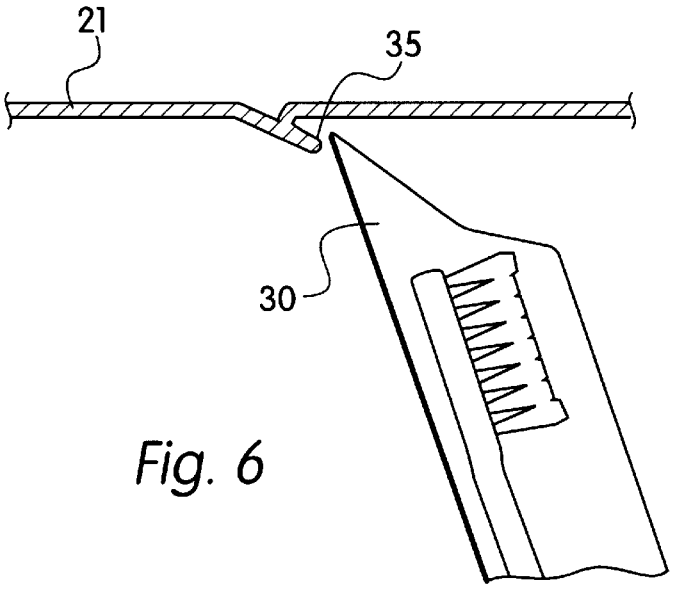
FIG. 6 is an enlarged view of section "A" of FIG. 5.

Referring to FIG. 6, there is shown an enlarged view of section A of FIG. 5. Retaining lip 35 prevents any rearward movement of next-in-line product 30.

Figure 7:
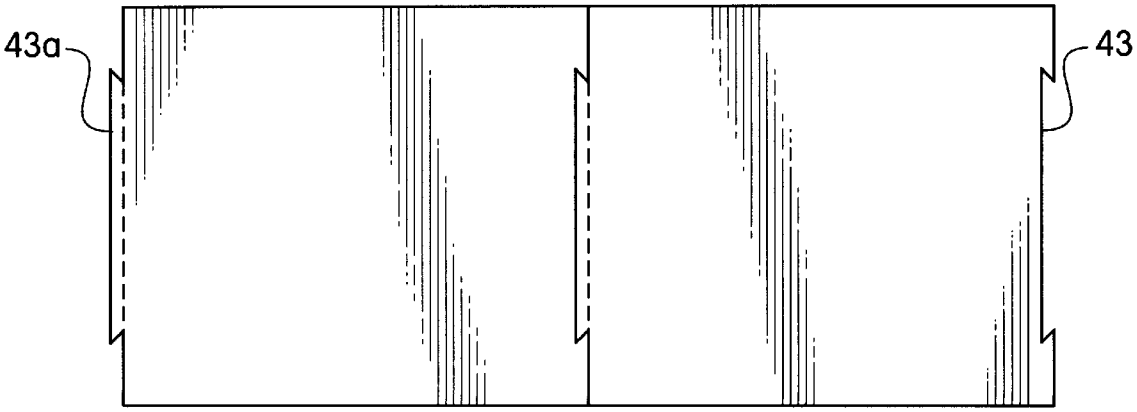
FIG. 7 is a bottom plan view of the invention detailing interlocking tabs.

Referring to FIG. 7, there is shown a top plan view of two identical product display devices 10 wherein side walls 14 and 15 also provide slidably interlocking members 43, and 43*a* so that a series of side-by-side trays may be stabilized in place on a shelf, for example.

Accordingly, while a single embodiment of the present invention has been shown and described, it is to be understood that many changes and modifications may be made thereunto without departing from the spirit and scope of the invention as defined in the appended claims.

What is claimed is:

1. A product display dispenser, comprising:

a tray having a front wall, back wall, a bottom wall and a pair of side walls wherein said walls are secured to each other at 90° angles forming a container;

a pusher, slidably supported in said tray;

means to urge said pusher toward said front wall of said tray to urge articles which may be placed in said tray toward said front wall;

a canopy disposed above said tray and extending forwardly toward said front wall, said canopy having an underside and a rear wall; and a retaining lip disposed on said underside of said canopy, said retaining lip is angled downwardly and extending toward said front wall of said tray, wherein said lip prevents articles from moving toward the rear of said tray when forwardmost articles are removed upwardly from said tray.

2. The product display dispenser according to claim 1, further comprising:

a storage divider wall, positioned at a fixed distance from said back wall and secured between each of said side walls of said tray forming a transverse compartment at the rear of said tray;

a plurality of divider walls removably supported between said front wall and said storage divider wall, wherein said divider walls define a plurality of front-to-back compartments in side-by-side relationship and wherein said transverse compartment is arranged to store at least one of said divider walls.

3. The product display dispenser according to claim 2, further comprising:

a plurality of pushers, slidably supported in said tray and disposed between each of said divider walls;

means to urge each of said pushers toward said front wall of said tray to urge articles which may be placed between said divider walls of said tray toward said front wall.

4. The product display dispenser according to claim 1, wherein said side walls further comprise:

a first slidably interlocking member; and a second slidably interlocking member, wherein said first and said second slidably interlocking members are attached so that a series of side-by-side trays may be stabilized in place on a shelf.

5. The product display dispenser according to claim 1, wherein said canopy further comprises at least two internal support tabs;

at least two side support tabs; and at least two external support tabs, wherein said tabs position said canopy above said tray and prevent any side-to-side or front-to-back movement of said canopy.

6. The product display dispenser according to claim 1, further comprising:

a piece of self-bonding tape disposed partially on said canopy and partially on said tray, wherein said tape prevents upward movement of said canopy.

* * * * *